US010352045B2

(12) United States Patent
Pattabhi

(10) Patent No.: US 10,352,045 B2
(45) Date of Patent: Jul. 16, 2019

(54) SYSTEM TO MOUNT CEILING TILES IN A COMPLETELY CONCEALED GRID SYSTEM WHERE INDIVIDUAL TILE CAN BE MOUNTED OR DISMOUNTED

(71) Applicant: Vangala Pattabhi, Hyderabad (IN)

(72) Inventor: Vangala Pattabhi, Hyderabad (IN)

( * ) Notice: Subject to any disclaimer, the term of this patent is extended or adjusted under 35 U.S.C. 154(b) by 0 days.

(21) Appl. No.: 15/524,392

(22) PCT Filed: Nov. 11, 2015

(86) PCT No.: PCT/IN2015/000417
§ 371 (c)(1),
(2) Date: May 4, 2017

(87) PCT Pub. No.: WO2017/017690
PCT Pub. Date: Feb. 2, 2017

(65) Prior Publication Data

US 2018/0155926 A1 Jun. 7, 2018

(30) Foreign Application Priority Data

Jul. 30, 2015 (IN) ..... 3919/CHE/2015

(51) Int. Cl.
*E04B 9/22* (2006.01)
*E04B 9/06* (2006.01)
(Continued)

(52) U.S. Cl.
CPC ..... *E04B 9/225* (2013.01); *E04B 9/067* (2013.01); *E04B 9/127* (2013.01); *E04B 9/28* (2013.01); *E04B 9/003* (2013.01); *E04B 9/247* (2013.01)

(58) Field of Classification Search
CPC . E04B 9/067; E04B 9/127; E04B 9/28; E04B 9/003; E04B 9/06; E04B 9/225; E04B 9/247; E04B 9/26; E04B 9/00; E04B 9/18
See application file for complete search history.

(56) References Cited

U.S. PATENT DOCUMENTS 1,826,133 A * 10/1931 Hatch ..... E04B 9/26 292/19
2,059,483 A * 11/1936 Parsons ..... E04B 9/26 52/506.06

(Continued)

FOREIGN PATENT DOCUMENTS

FR 2937664 A1 4/2010
FR 3011021 A1 3/2015

(Continued)

*Primary Examiner* — Adriana Figueroa
*Assistant Examiner* — Jessie T Fonseca
(74) *Attorney, Agent, or Firm* — The Webb Law Firm

(57) ABSTRACT

A method for installation of ceiling tiles in an improved mounting hook assembly to form a concealed grid system, the mounting hook assembly being attachable to a mounting stud (1) having recess on top portion to accommodate screws and fixed at the back of each tiles. The method includes attaching the mounting hook assembly to the tile; rotating a load bearing lever member; rotating a positioning lever member to position the load bearing member on a flange of a T grid bar; and fixing the tile below the T grid at a distance that is greater than the thickness of the tile so that when the tile is lifted up, the load bearing lever are returned to a position above the flange level of the T grid and any tile can be removed or installed in totally concealed grid system without dislocating tiles already laid.

7 Claims, 28 Drawing Sheets

(51) Int. Cl.

| | |
|---|---|
| ***E04B 9/12*** | (2006.01) |
| ***E04B 9/28*** | (2006.01) |
| *E04B 9/00* | (2006.01) |
| *E04B 9/24* | (2006.01) |

(56) References Cited

U.S. PATENT DOCUMENTS

| | | | | | |
|---|---|---|---|---|---|
| 2,066,205 | A * | 12/1936 | Keating | E04B 9/068 | 52/370 |
| 3,360,896 | A * | 1/1968 | Wright | E04B 9/20 | 52/126.1 |
| 3,832,816 | A | 9/1974 | Jahn | | |
| 4,279,110 | A * | 7/1981 | Palazzolo | E04B 9/247 | 52/393 |
| 4,432,182 | A * | 2/1984 | Addie | E04B 9/26 | 52/480 |
| 4,463,537 | A * | 8/1984 | Rodriquez | E04B 9/225 | 52/506.07 |
| 4,648,229 | A | 3/1987 | Limp | | |
| 4,760,677 | A * | 8/1988 | Nassof | E04B 9/28 | 52/145 |
| 5,024,034 | A * | 6/1991 | Gailey | E04B 9/24 | 52/506.07 |
| 5,263,292 | A * | 11/1993 | Holland | E04B 2/92 | 52/235 |
| 5,355,648 | A * | 10/1994 | Graver | E04B 9/24 | 52/506.05 |
| 5,428,930 | A | 7/1995 | Bagley et al. | | |
| 5,845,447 | A * | 12/1998 | Bodine | E04B 9/0478 | 52/506.09 |
| 6,205,733 | B1 * | 3/2001 | LaLonde | E04B 9/067 | 52/506.07 |
| 8,056,294 | B2 | 11/2011 | LaLonde | | |
| 9,670,674 | B2 * | 6/2017 | St-Laurent | E04B 9/22 | |
| 2015/0167297 | A1 * | 6/2015 | St-Laurent | E04B 9/20 | 52/506.05 |
| 2015/0308112 | A1 * | 10/2015 | Holdridge | E04B 9/10 | 52/506.05 |
| 2015/0345139 | A1 * | 12/2015 | Underkofler | E04B 9/003 | 52/506.08 |
| 2016/0145863 | A1 * | 5/2016 | Bergman | E04B 9/225 | 52/506.05 |

FOREIGN PATENT DOCUMENTS

| | | |
|---|---|---|
| GB | 494240 | 10/1938 |
| GB | 856716 | 12/1960 |

* cited by examiner

LL – LOAD BEARING LEVER
PL – POSITIONING LEVER

Figure 2:
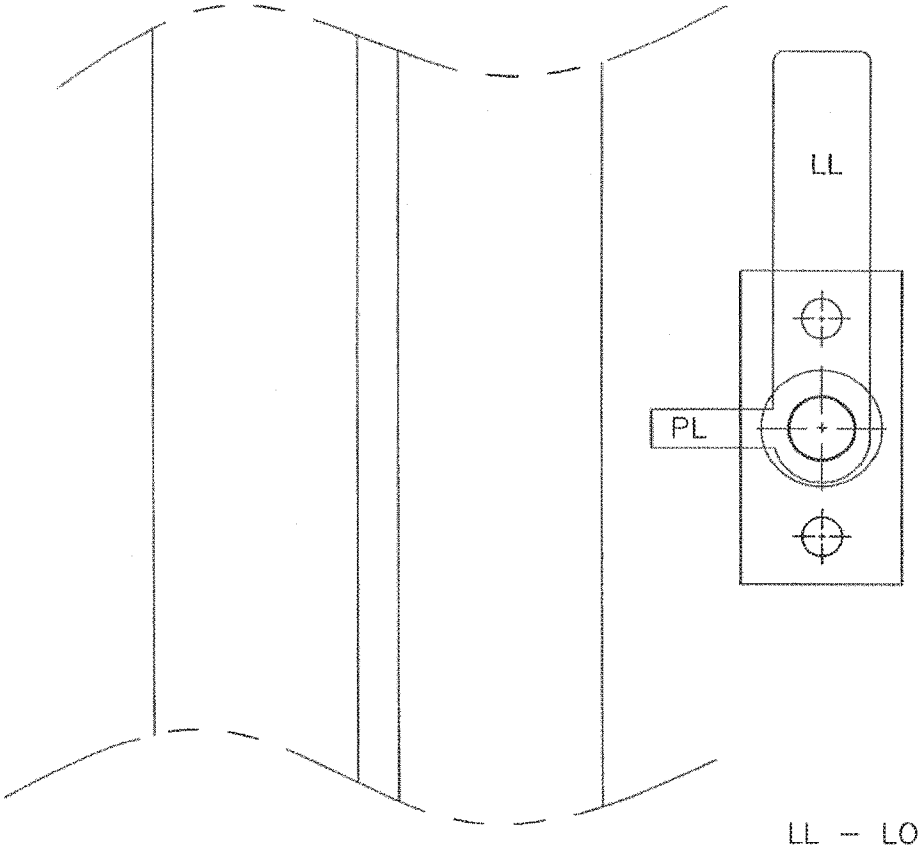

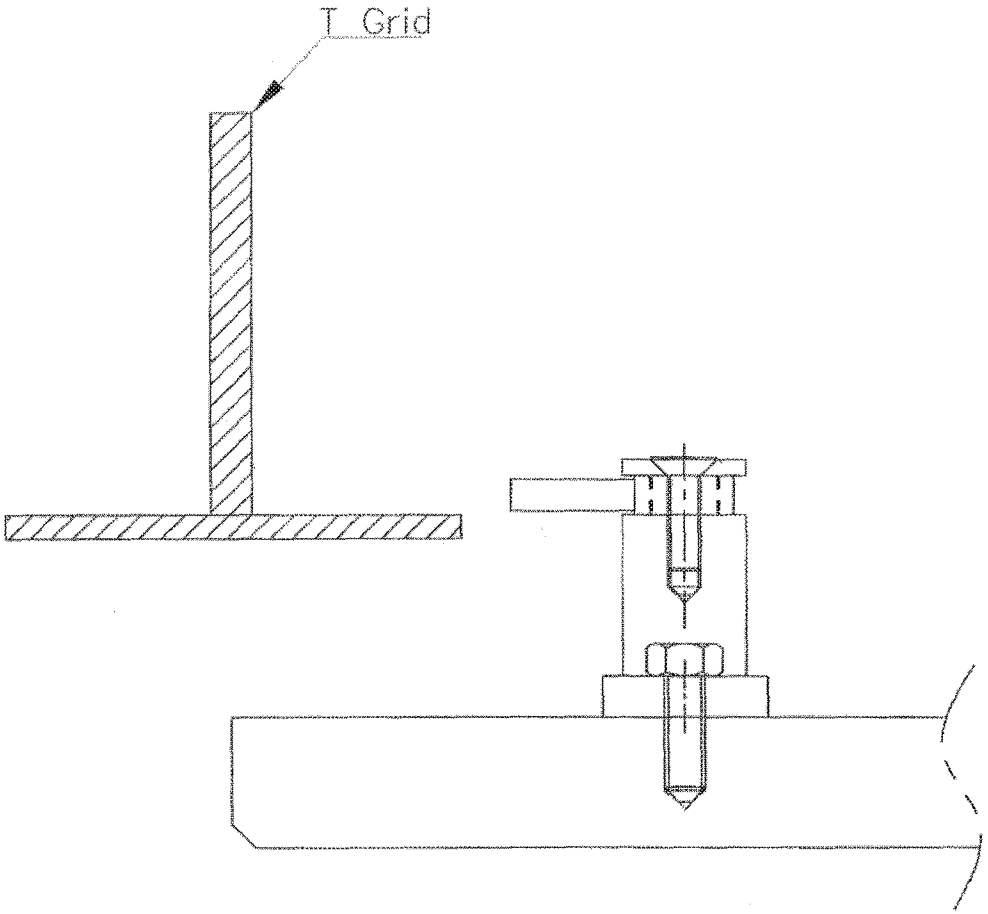
Fig-2.A

Figure 3:
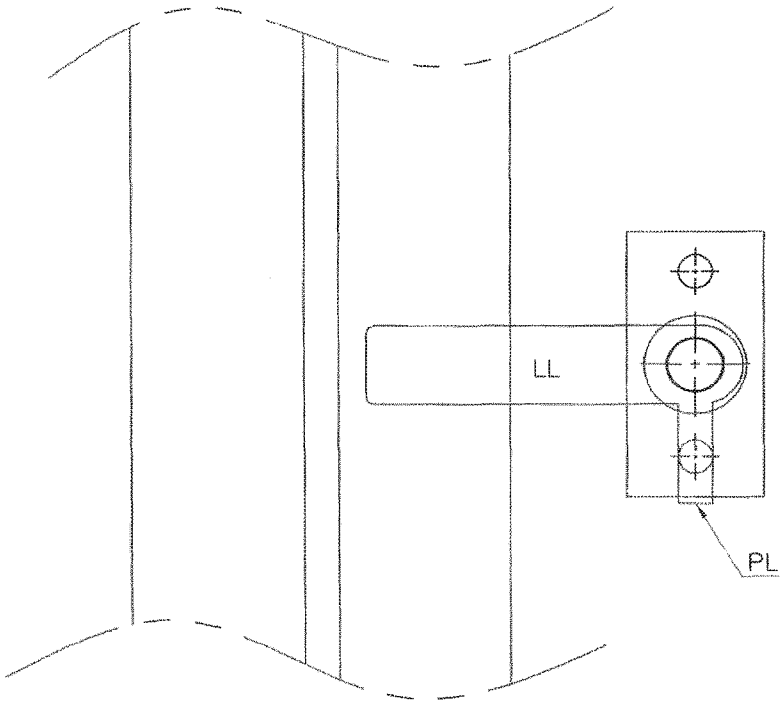

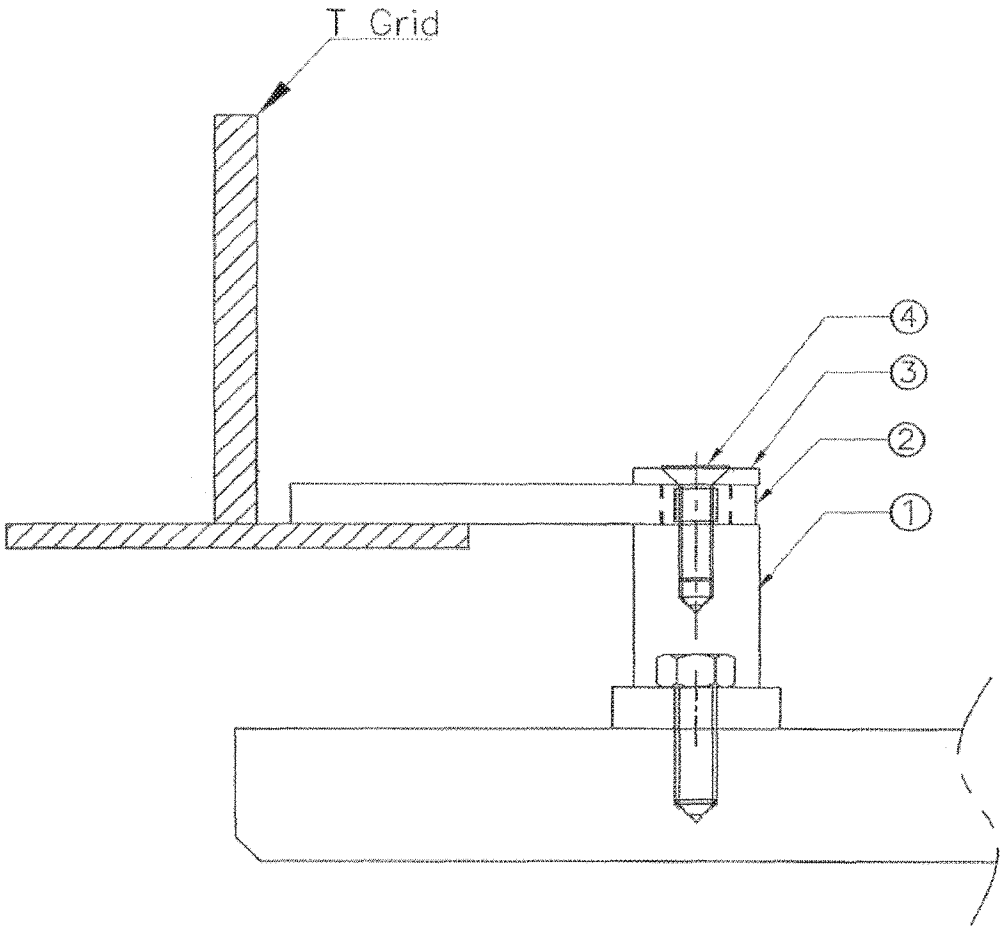
Fig-3.A

Figure 5:
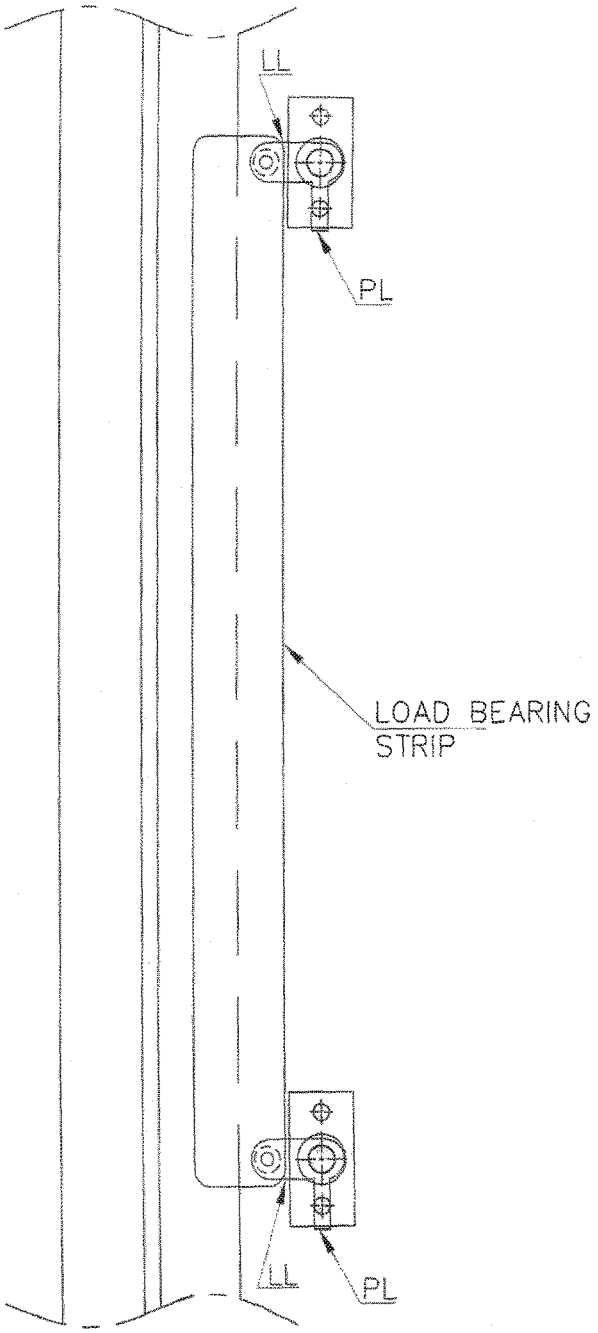

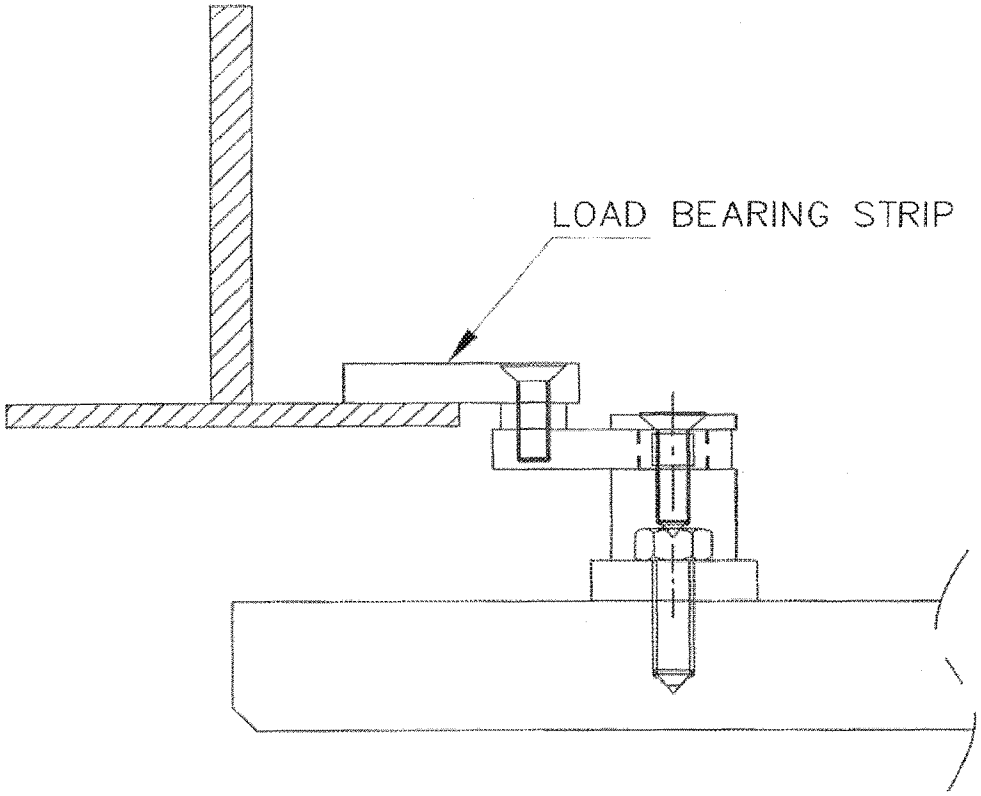
Fig-5.A

BEFORE FIXING TO "T"

AFTER FIXING TO "T"

AFTER FIXING TO "T"

Figure 8:
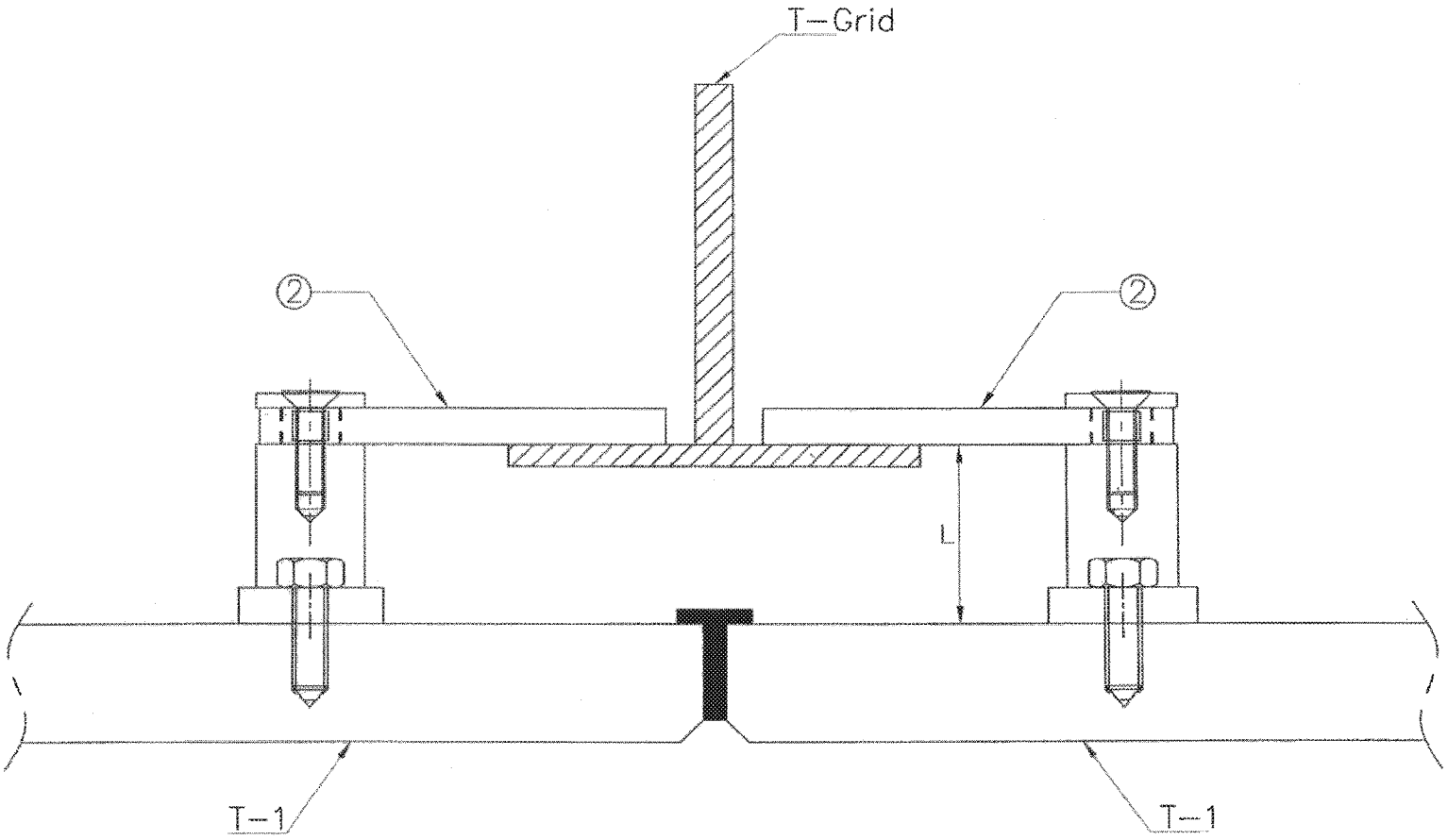

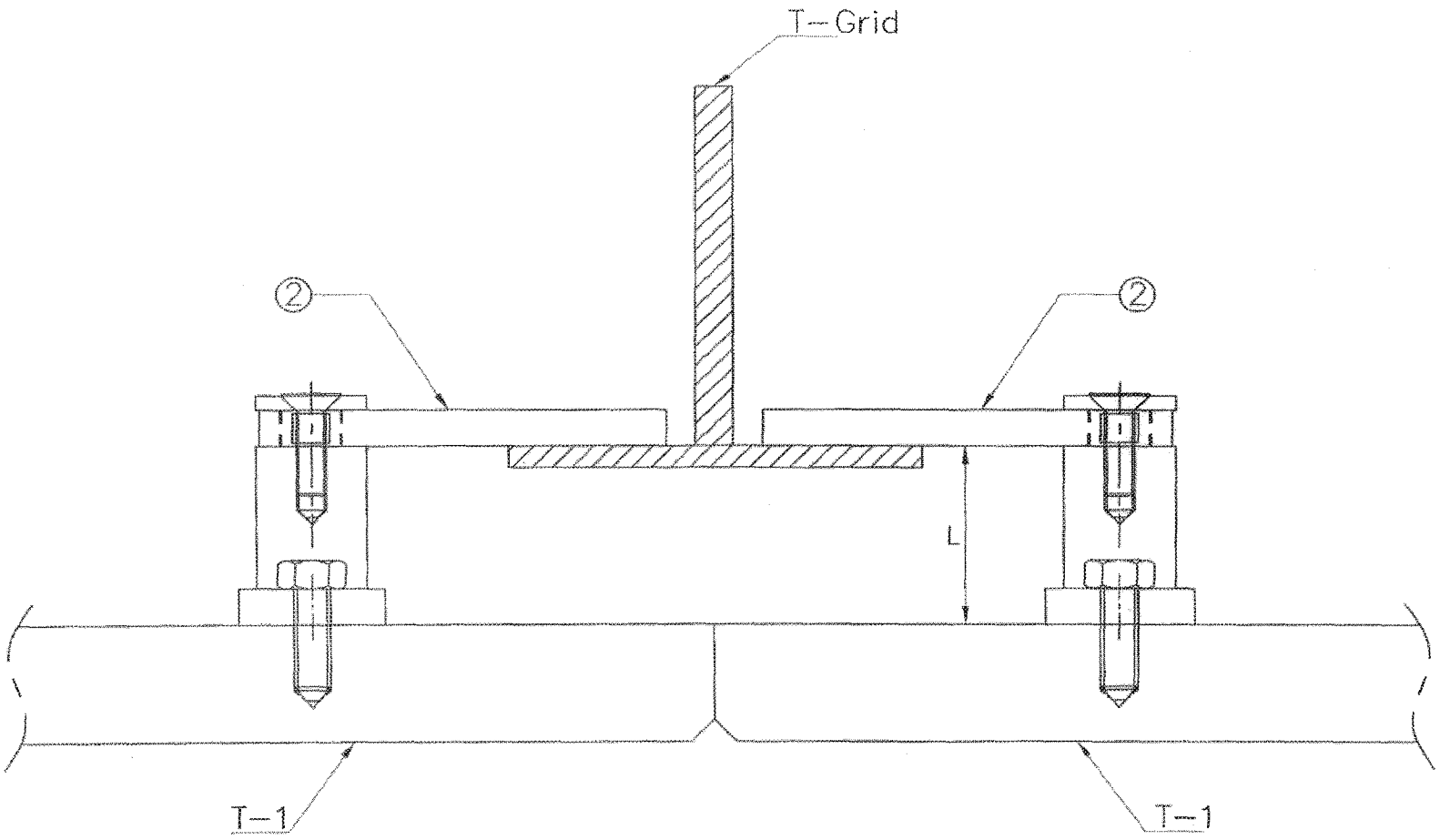
Fig-8.A

Figure 10:
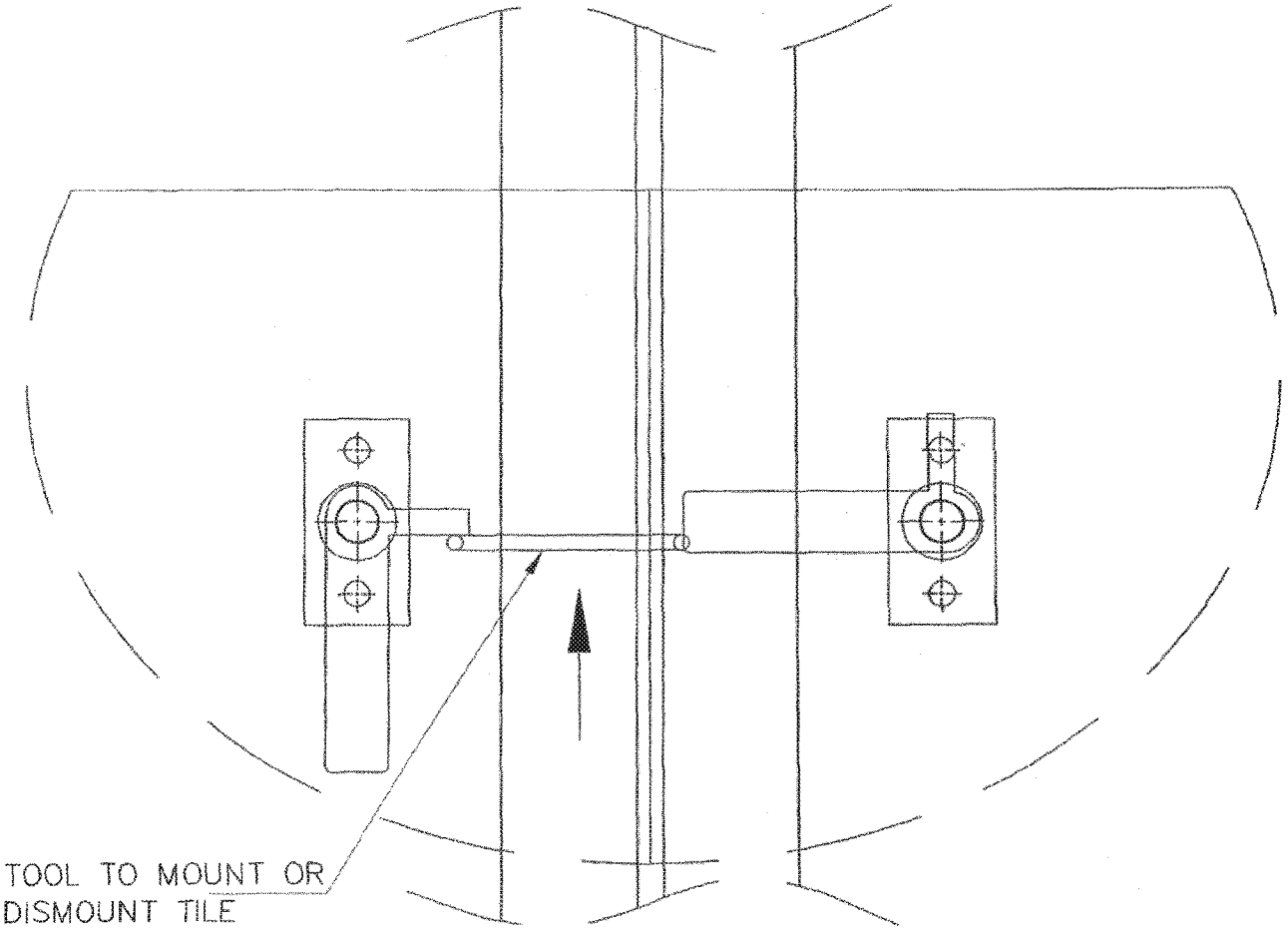

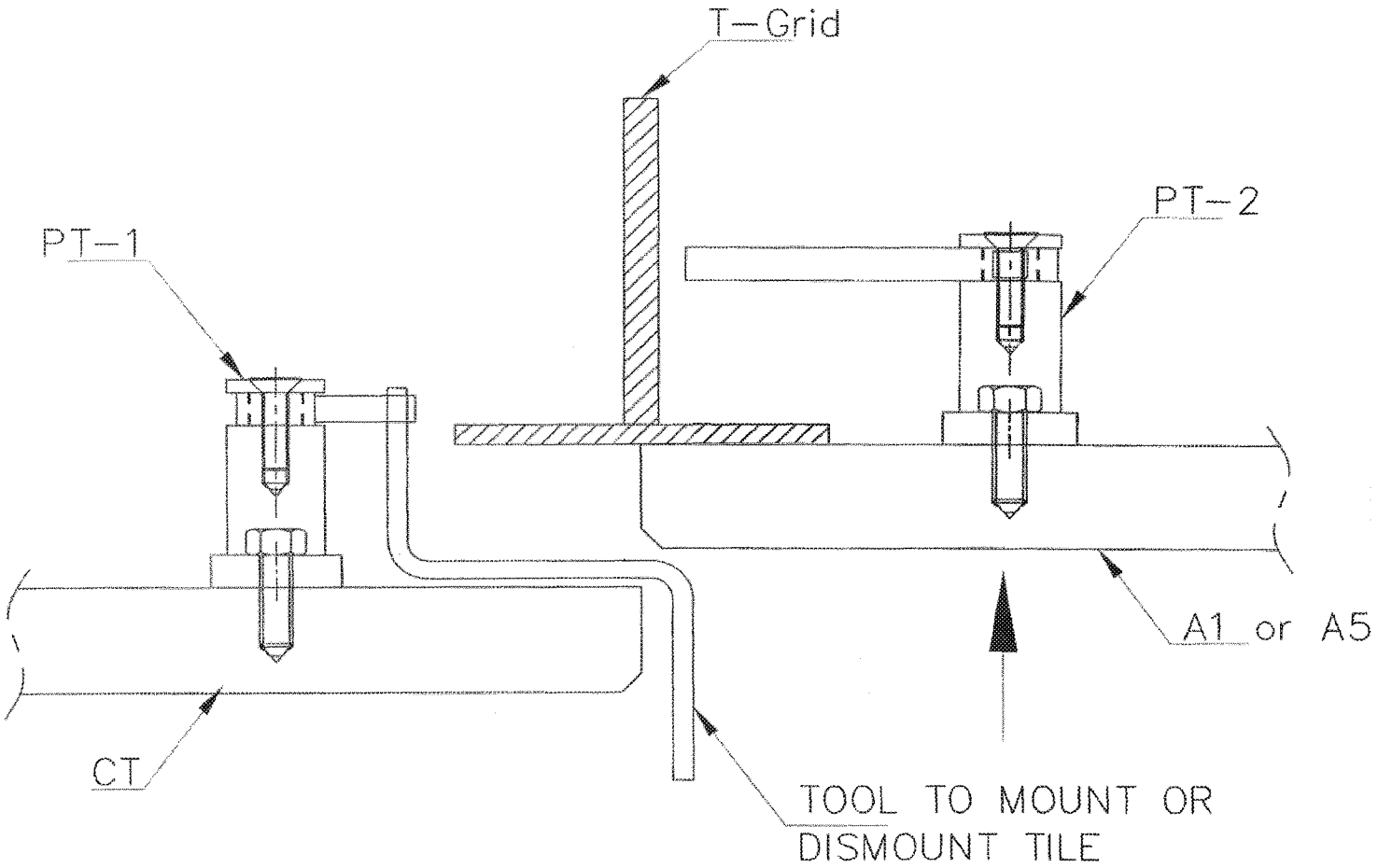
Fig-10.A

Figure 11:
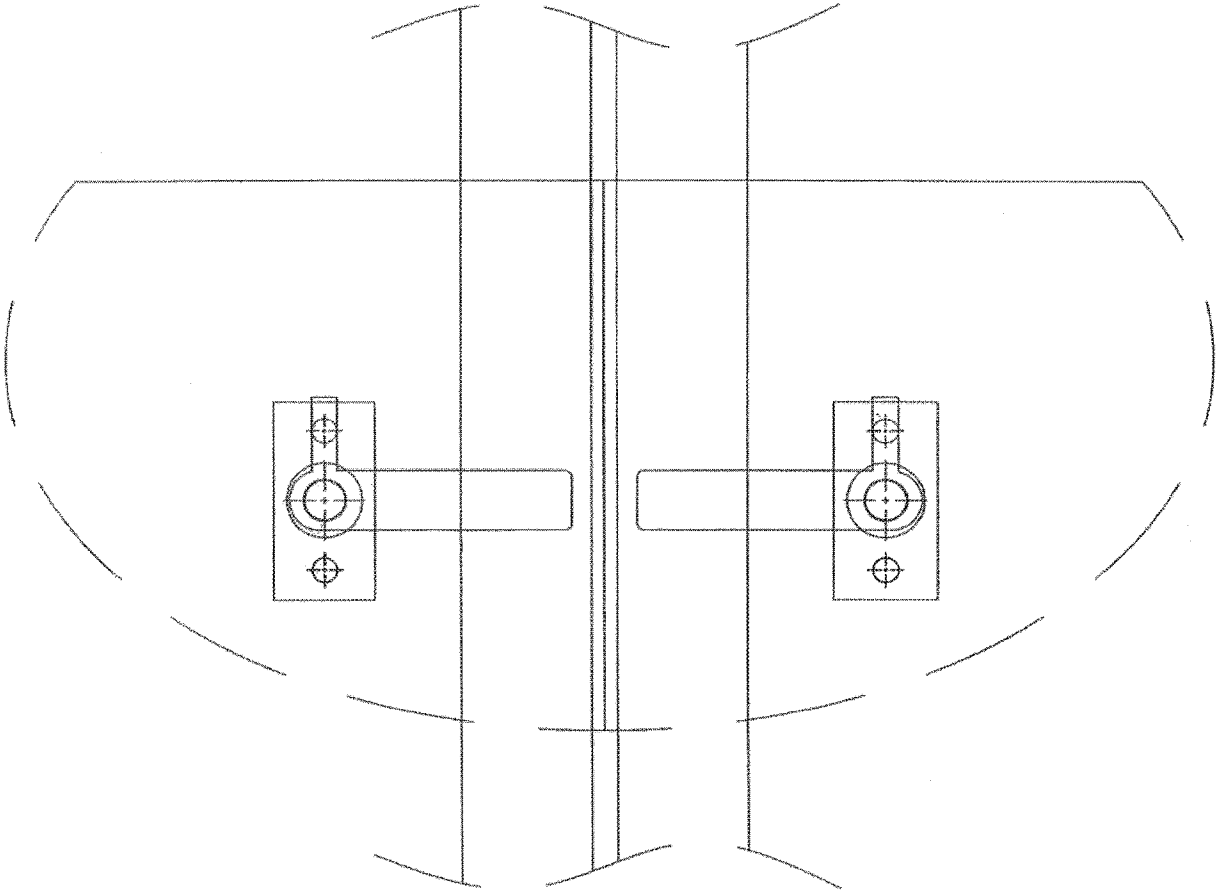

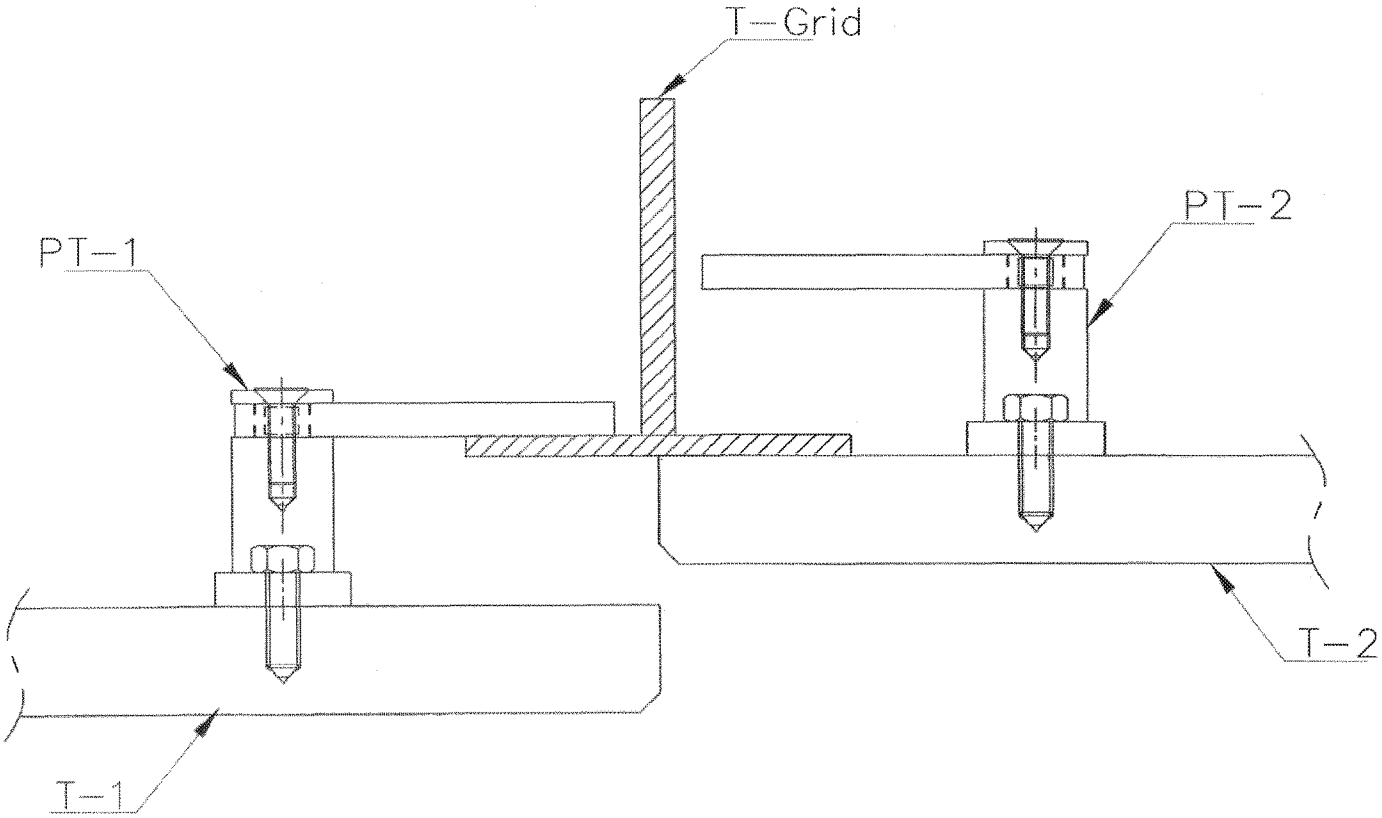
Fig-11.A

Figure 13:
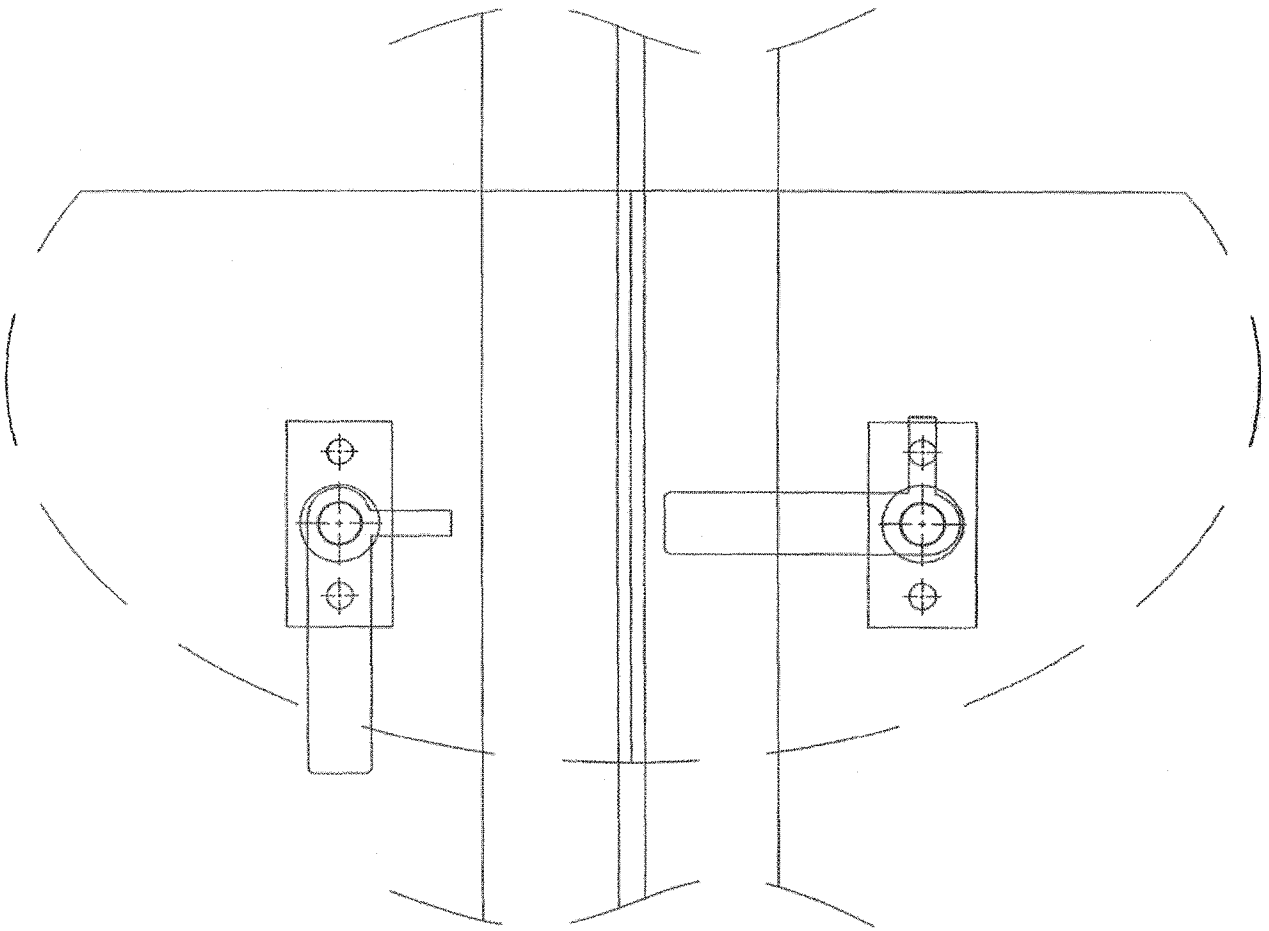

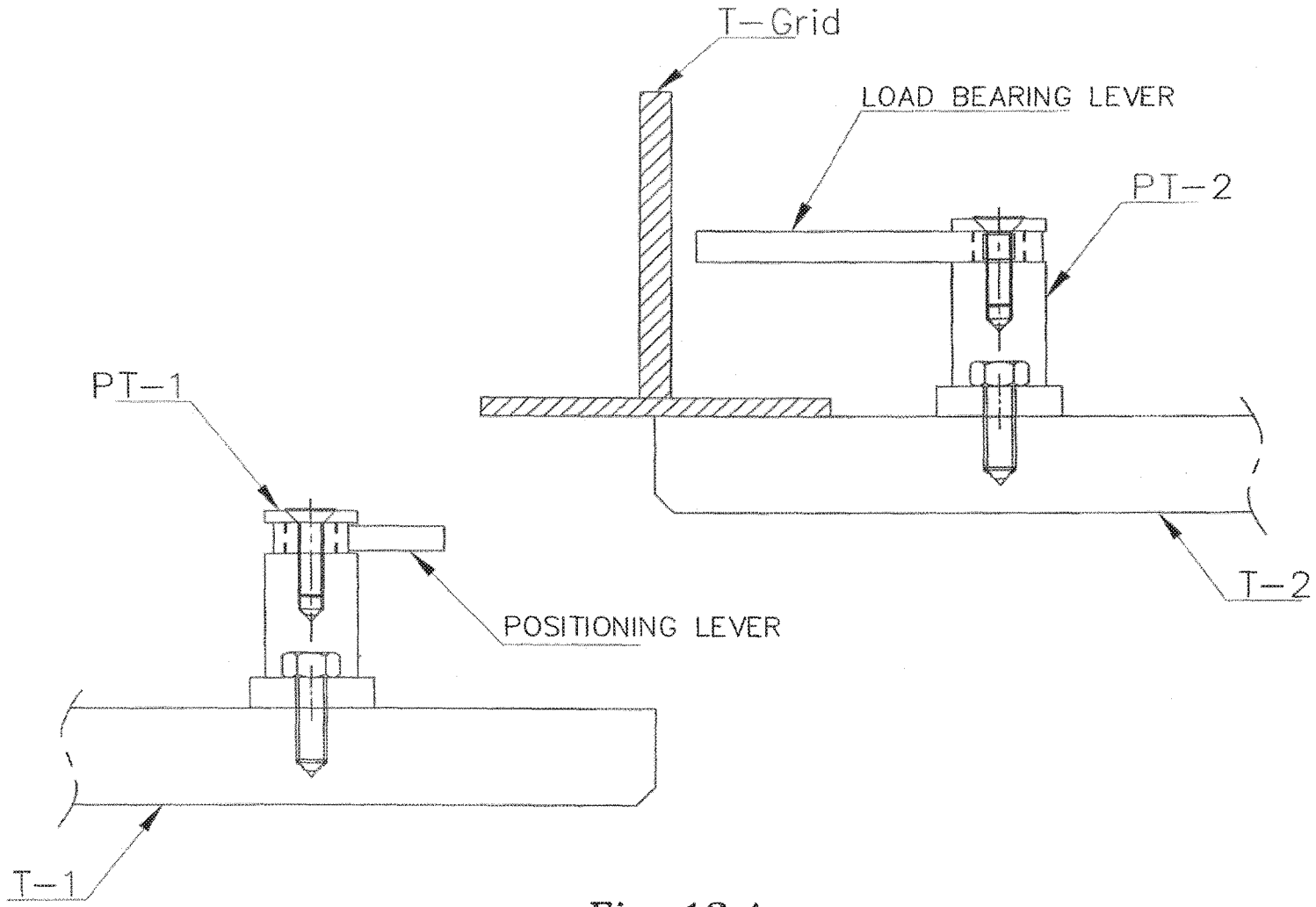
Fig-13.A

BEFORE FIXING TO "T"

AFTER FIXING TO "T"

Figure 15:
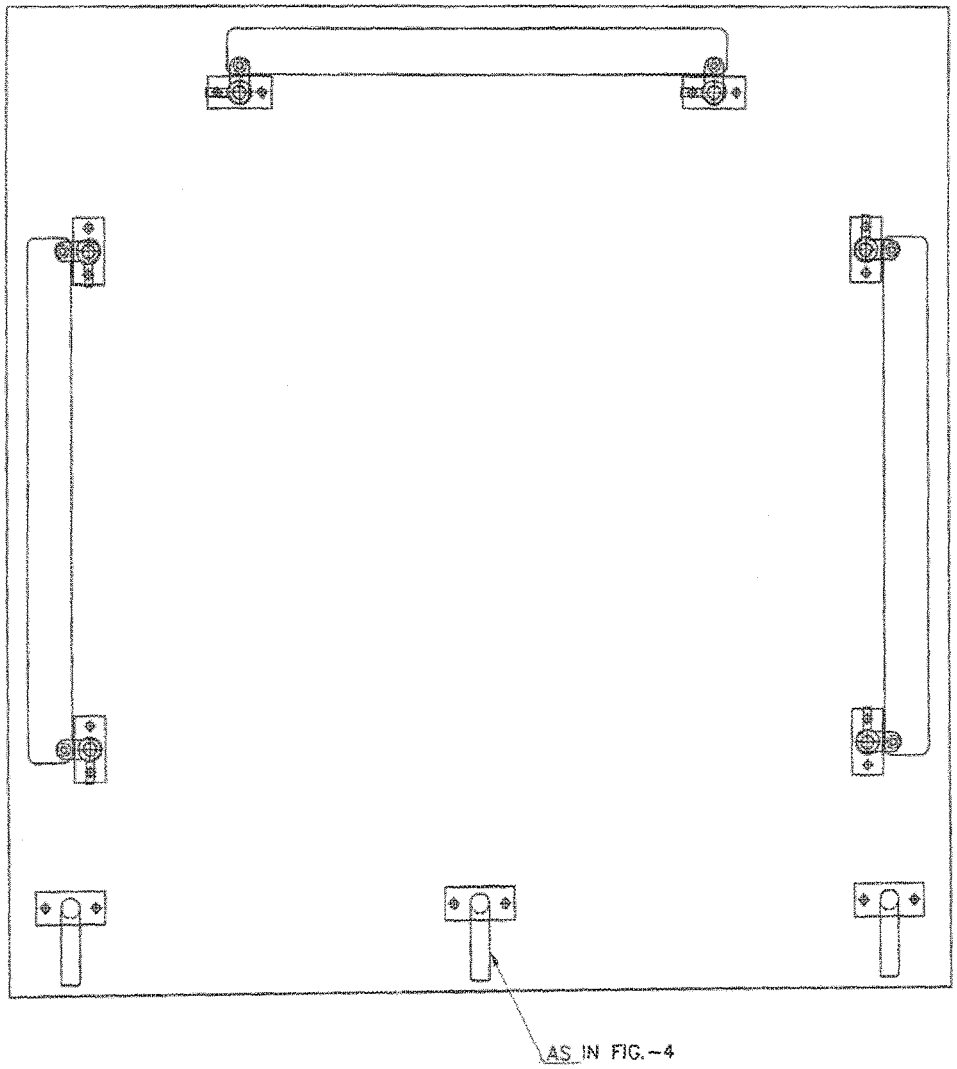

AFTER FIXING TO "T"
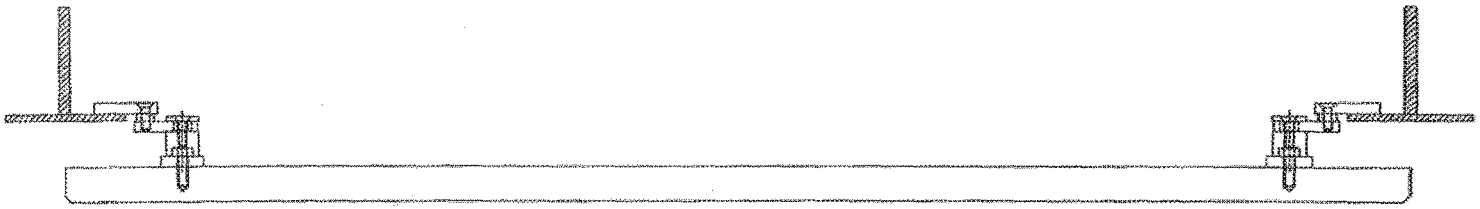
Fig-15.B

A) ROTATABLE LEVER ② WITH LOAD BEARING LEVER TOWARDS T GRID.

B) ROTATABLE LEVER ② WITH POSITIONING LEVER TOWARDS T GRID.

C) BRACKET TO INSERT IN KERFING WITH ROTATABLE LEVER ON TOP.

SYSTEM TO MOUNT CEILING TILES IN A COMPLETELY CONCEALED GRID SYSTEM WHERE INDIVIDUAL TILE CAN BE MOUNTED OR DISMOUNTED

CROSS-REFERENCE TO RELATED APPLICATIONS

This application is the United States national phase of International Application No. PCT/IN2015/000417 filed Nov. 11, 2015, and claims priority to Indian Patent Application No. 3919/CHE/2015 filed Jul. 30, 2015, the disclosures of which are hereby incorporated in their entirety by reference.

BACKGROUND OF THE INVENTION

Field of the Invention

The present invention relates to an improved mounting hook assembly for mounting and dismounting of any ceiling tile from a concealed suspended T-grid. More particularly the invention relates a method for installation of ceiling tiles in an improved mounting hook assembly to form a concealed grid system using commonly used T grid suspension.

Description of Related Art

There exists concealed grid systems for mounting and dismounting of tiles, all of them are not suitable for every location. There are also dismountable systems that require one or several of following:—

A thick tile say 20 mm is needed to have edge slots that make the edges weak. It requires complicated systems of special hooks or springs or attachments making it sometimes complicated and requires special skilled persons.

U.S. Pat. No. 5,428,930A describes a grid system which needs special hooks that are attached to T grid and torsion springs that are attached to another grid cell which carries tiles that are grooved (kerfing) on all ends, accurately manufactured and assembled. Thus, this prior system additionally require a tile that has property and thickness to have kerfing. Two grid cells are needed with several accessories to be attached to each of these cells with accuracy of component and assembly.

U.S. Pat. No. 4,648,229A uses special hooks attached to a special rectangular grid system to which these hooks are attached. Other grid of hooks is flanged spline inserted in kerfing. This system needs roofing additional accessories and is not completely concealing the suspension as the bottom of the rectangular position appears between tiles.

Kerfing needed and rectangular grid member instead of normal T grid is essential.

U.S. Pat. No. 3,832,816A utilizes a movable cross member and tiles laid to be supported on cross members on opposite sides and other sides leaving free. The disadvantages are:

a) The free sides are subjected to sagging with unsupported length.

b) Special construction of T grid is needed as well as movable cross member. Tiles with kerfing are inserted in flange of T grid.

c) Standard T grid not suitable. Not suitable for tiles that do not have property and thickness for kerfing. Not suitable to mount on standard T grid.

Access above ceiling by providing yet another hook arrangement by over laying the hooks enabling to lift one of the tiles. This is a varied construction and tiles with end grooves (kerfing) is also needed that demands a tile of required thickness.

U.S. Pat. No. 8,056,294B2 provides a, special suspended system comprising torsion springs attached and the titles machined accurately to fit into the type of spring suspension. This prior art require extensive special kerfing to match with the selected torsion springs, which makes it a complicated system. Tiles without kerfing are not suitable, standard T grid is not suitable, intricate hooking springs are utilized.

SUMMARY OF THE INVENTION

It is therefore an object of the invention to propose a method for installation of ceiling tiles in an improved mounting hook assembly to form a concealed grid system.

Another object of the invention is to propose a method for installation of ceiling tiles in an improved mounting hook assembly to form a concealed grid system, which allows individual tiles to be mounted/dismounted without affecting adjacently installed tiles.

A still another object of the invention is to propose a method for installation of ceiling tiles in an improved mounting hook assembly to form a concealed grid system, which is implementable with existing suspension grids.

A further object of the invention is to propose a method for installation of ceiling tiles in an improved mounting hook assembly to form a concealed grid system, which is simple and can be accomplished by minimally skilled persons.

The disclosed process is meant to be used with tiles of exact thickness and cut accurately to dimensions relative to the grid used. For example: A grid of 600×600 mm needs tiles to be cut to same dimensions with no diagonal differences in length and may have any standardized thickness. An inventive mounting hook assembly is attached at the back of the tile at pre determined locations. Such mounting hook assembly is attached to a mounting stud, and consists of a rotating LB (Load bearing) lever member that transfers the weight of the tile on to the flange of a suspended inverted T bar grid.

As a further improvement such rotating assemblies are limited to three sides of the ceiling membrane and the fourth side is fixed (non rotating) mounting hook assembly.

A simple tool such as a bent rod of say 6 mm dia or square with a handle is used to mount or dismount the title by rotating the LB member to either be perpendicular or parallel to the flange of a T bar to mount or dismount the tile.

Yet another embodiment of this method is the individual mounting or dismounting of the grid by suspending the tile at a level below the grid that is more than the thickness of the tile to be installed. The disclosed novel method can be understood with the following description and referred accompanying drawings. The engineering details are only for the purpose of easy understanding and do not limit the concept of this invention.

BRIEF DESCRIPTION OF THE ACCOMPANYING DRAWINGS

Figure 1:
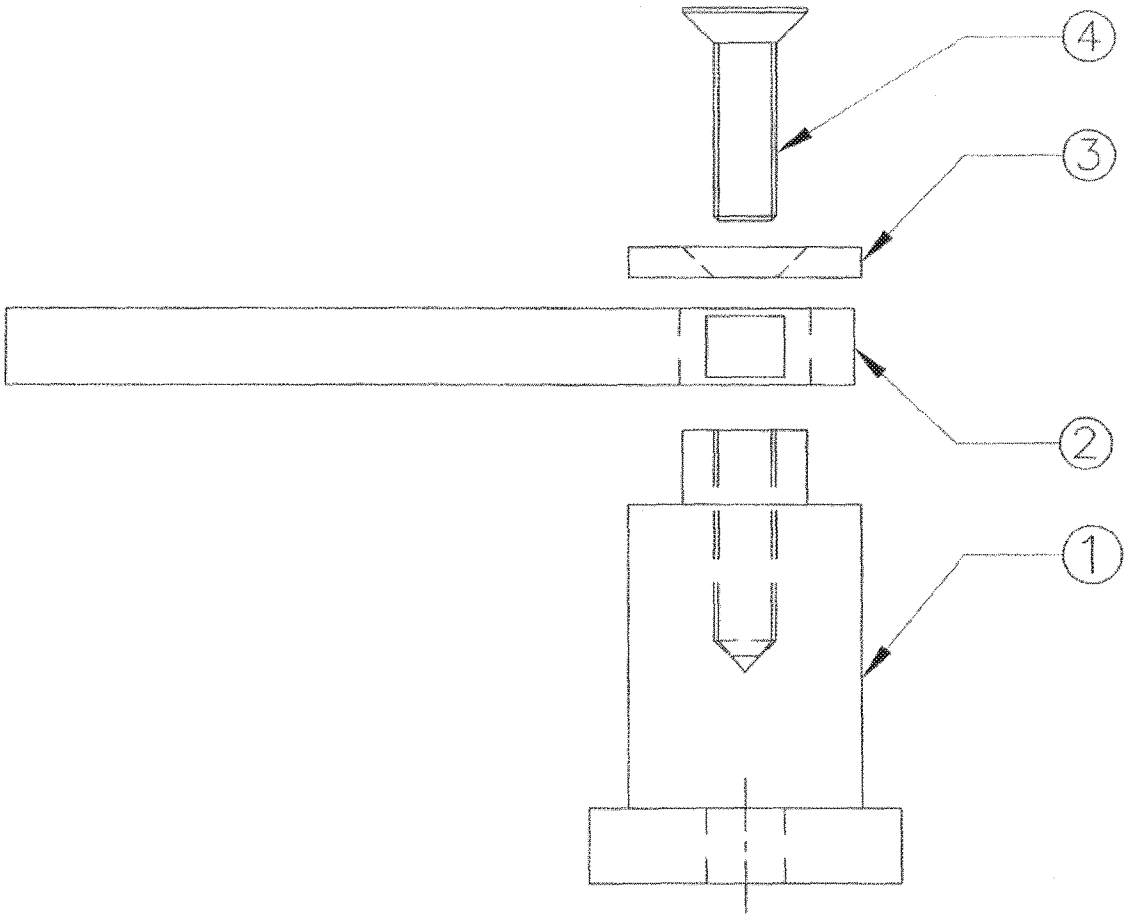

FIG. 1—shows the mounting assembly of the inventive concealed grid system.

FIGS. 2 and 2A—show views of the rotating lever of the concealed grid system with PL facing grid.

FIGS. 3 and 3A—show views of rotating lever with LL resting on a flange of the T-member.

Figure 4:
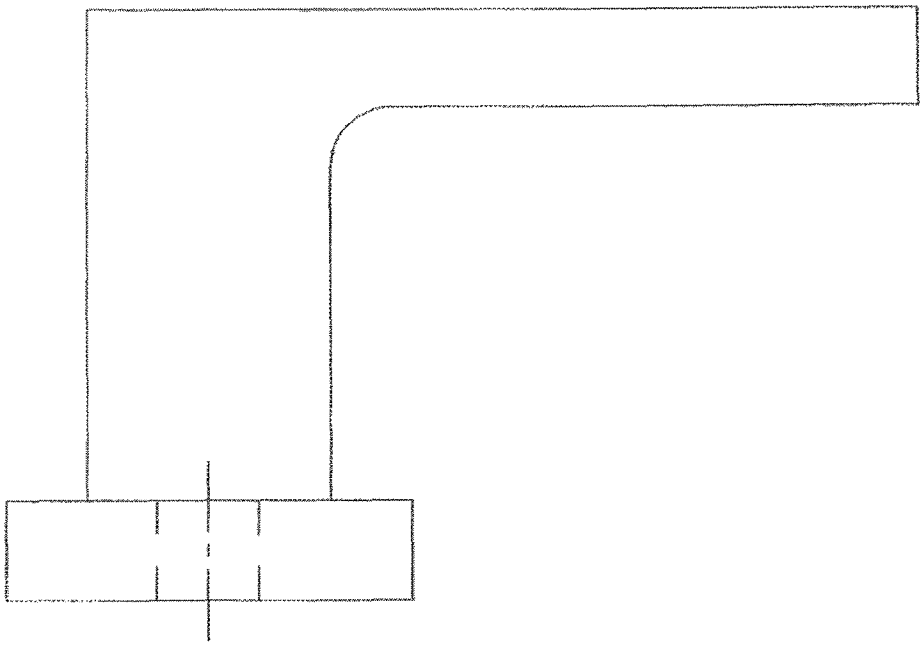

FIG. 4—shows that fixed studs mounted on one side of tile.

FIGS. 5 and 5A—show that load bearing levers of the system can be joined by load bearing strips.

Figure 6:
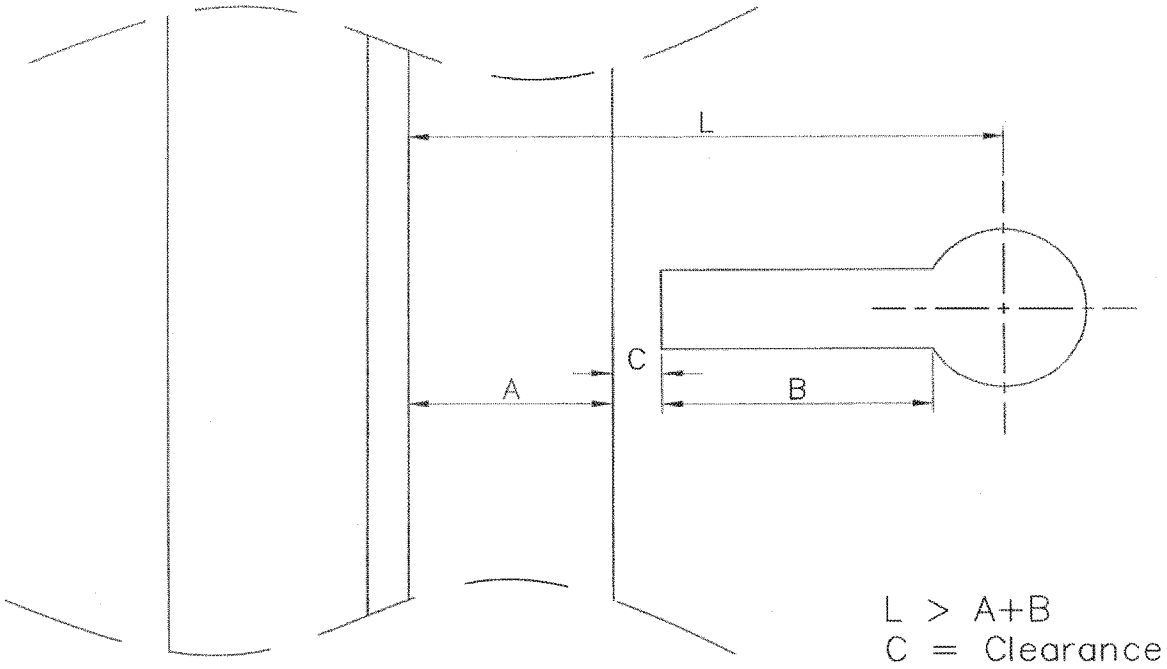

FIG. 6—shows the distance between tile's edge and center for fixing of a stud.

Figure 7:
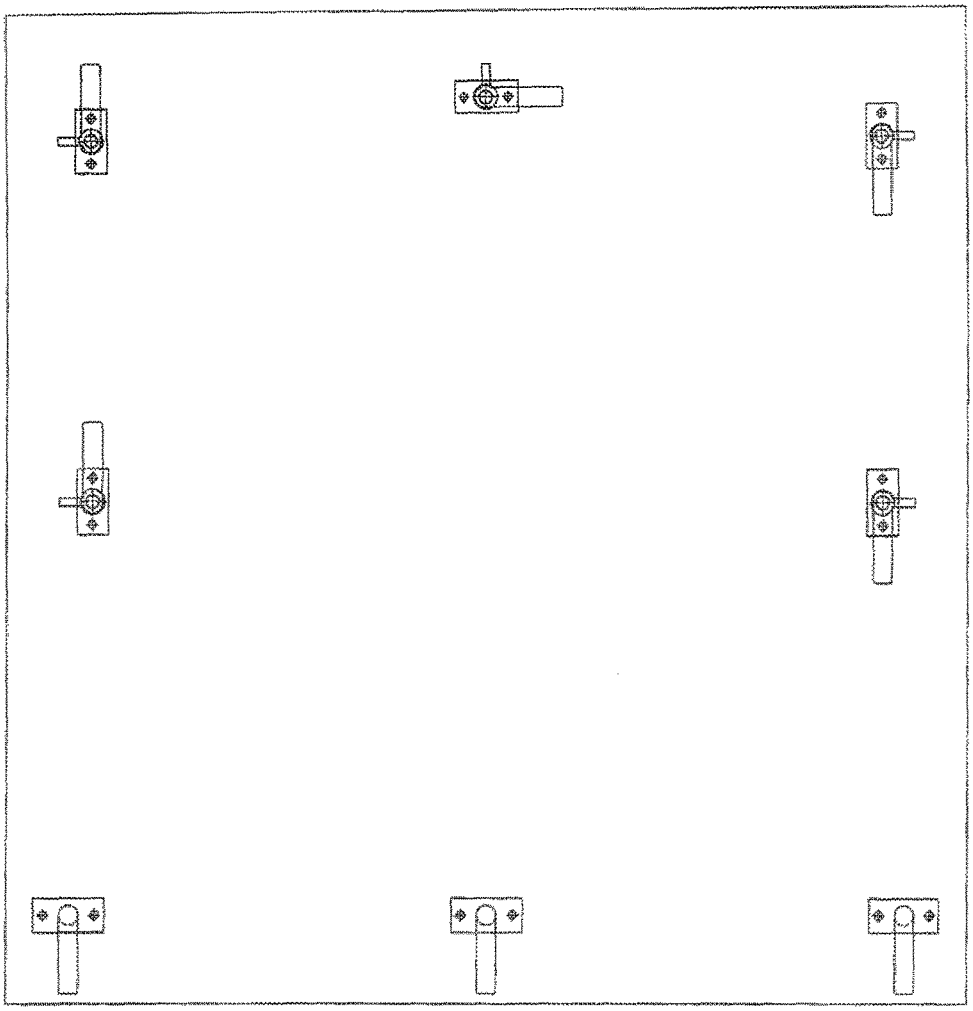

FIG. 7 shows the tile is now fixed with studs.

Figure 7A:
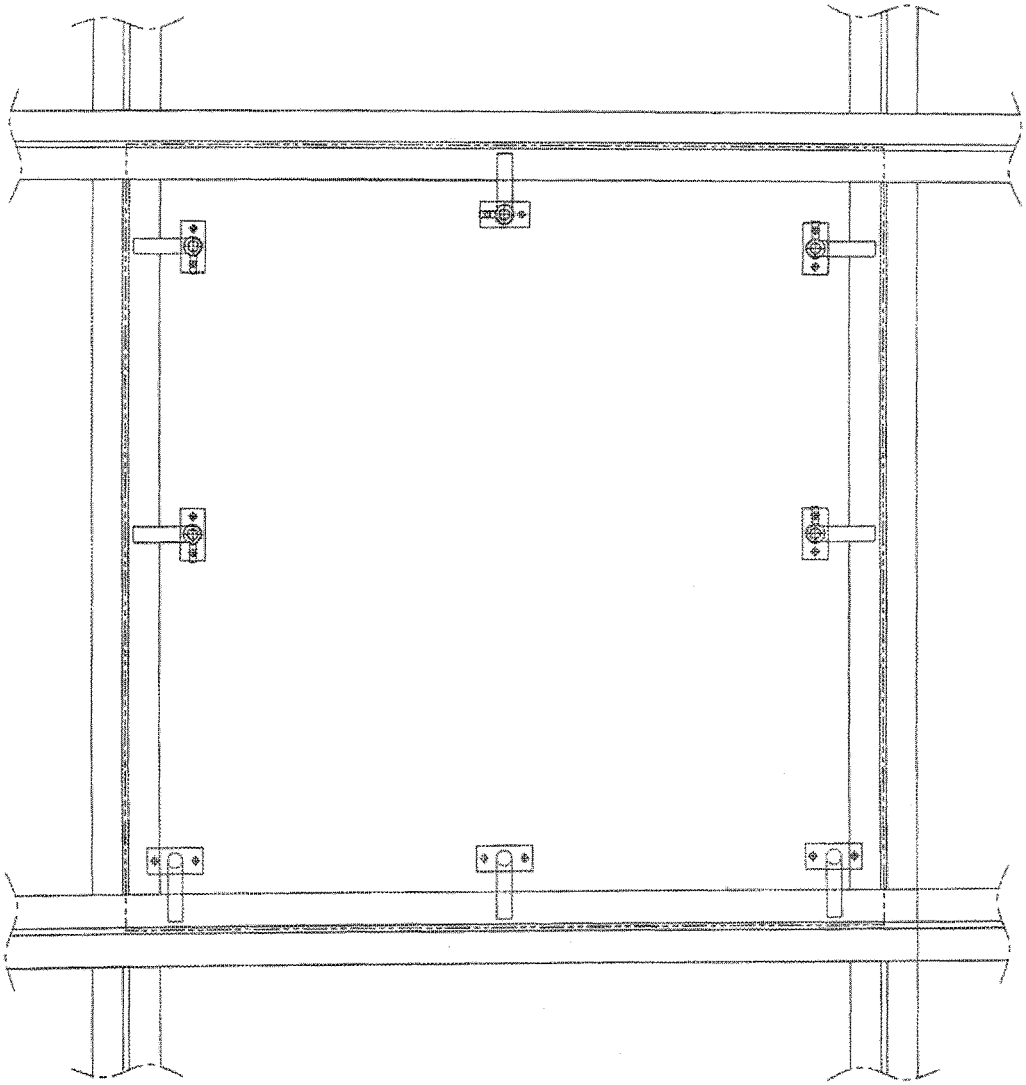

FIG. 7A—shows post-adjustment position of all the levers when the long lever remains parallel to the edge of tiles wherein the short lever is towards the flange of T grid.

Figure 7B:
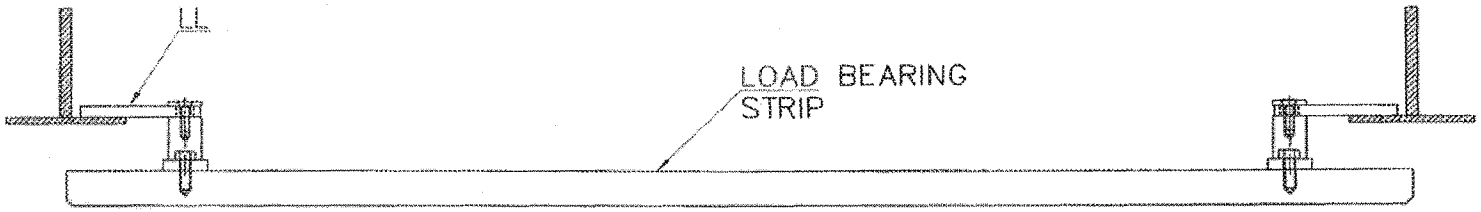

FIG. 7B—shows the position of the long levers when the tile is lowered.

FIG. 8—shows elevational view of the tiles on the T grid with decorative insertion between tiles.

FIG. 8A—shows the tiles resting on the T grid.

Figure 9:
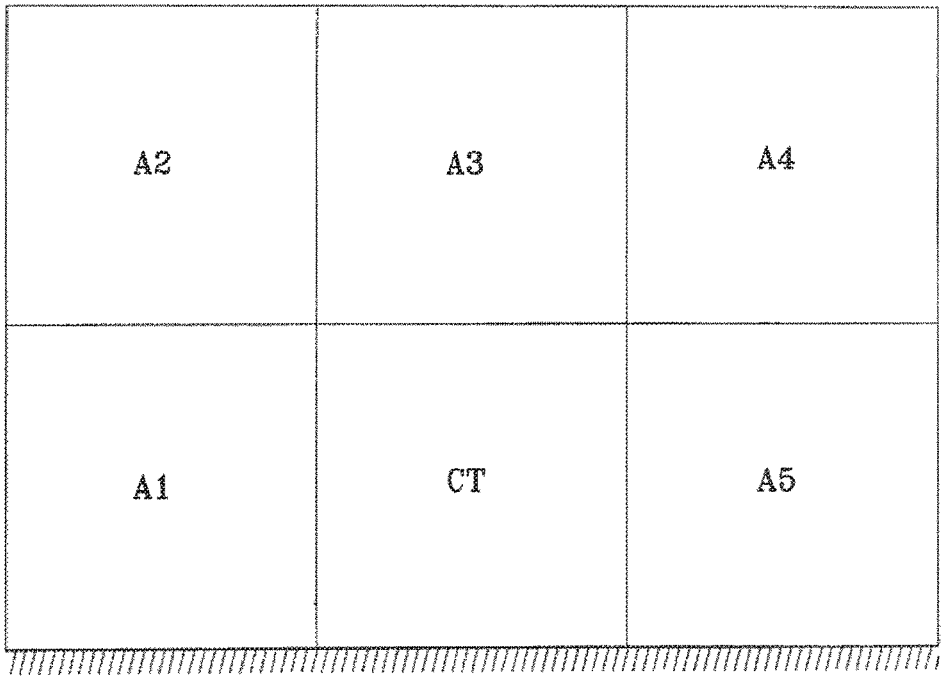

FIG. 9—shows laying of all tiles except the closing tile for installation.

FIGS. 10 and 10A—show a plurality of clamps attached to the grid for holding the tiles in lifted position at grid level with the bent tool inserted to rotate the lever.

FIGS. 11 and 2A—show turning of the long lever on the flange.

Figure 12:
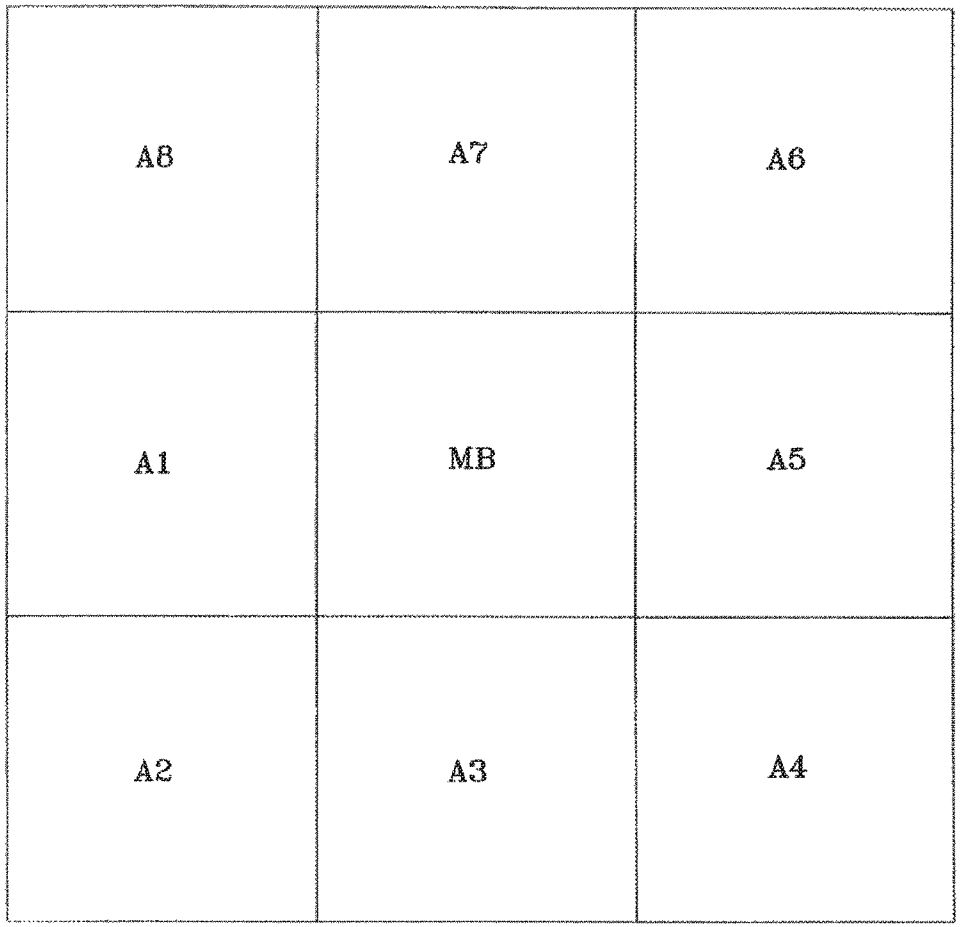

FIG. 12—shows a typical grid with plurality of tiles.

FIGS. 13 and 13A—show mounting/dismounting of the tile T1 with adjacent tile T2 in lifted position.

Figure 14:
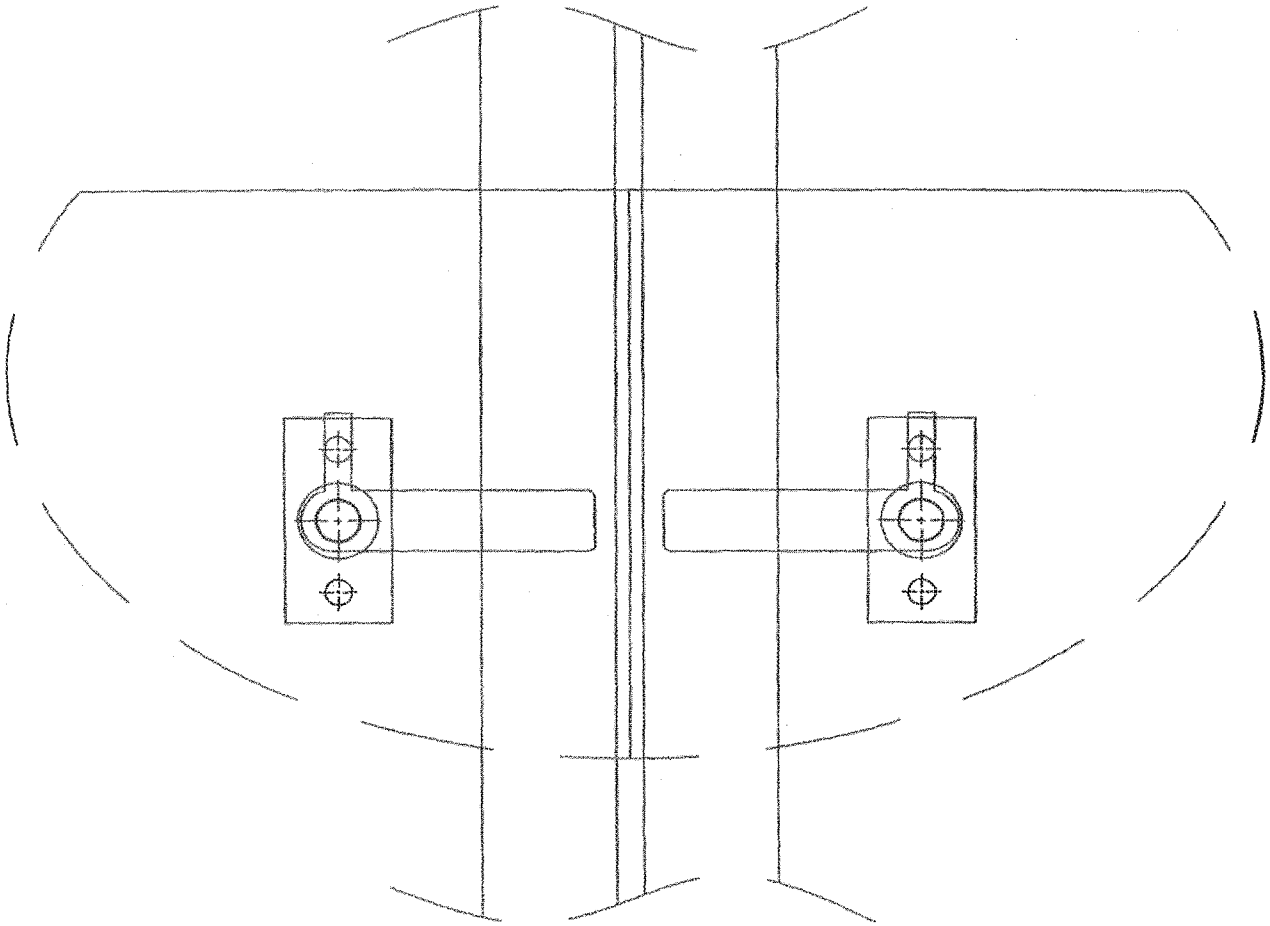
Figure 14A:
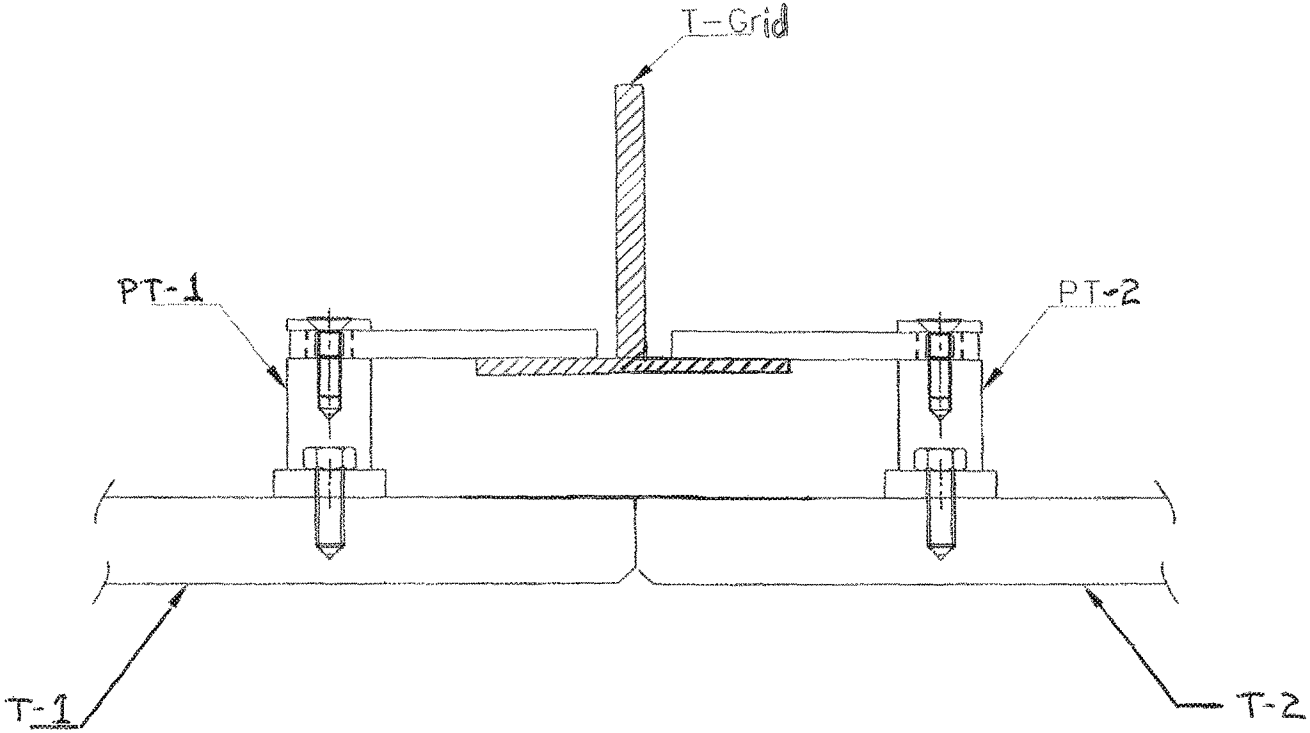

FIGS. 14 and 14A—shows the top of all the tiles are at same level after installation.

Figure 15A:
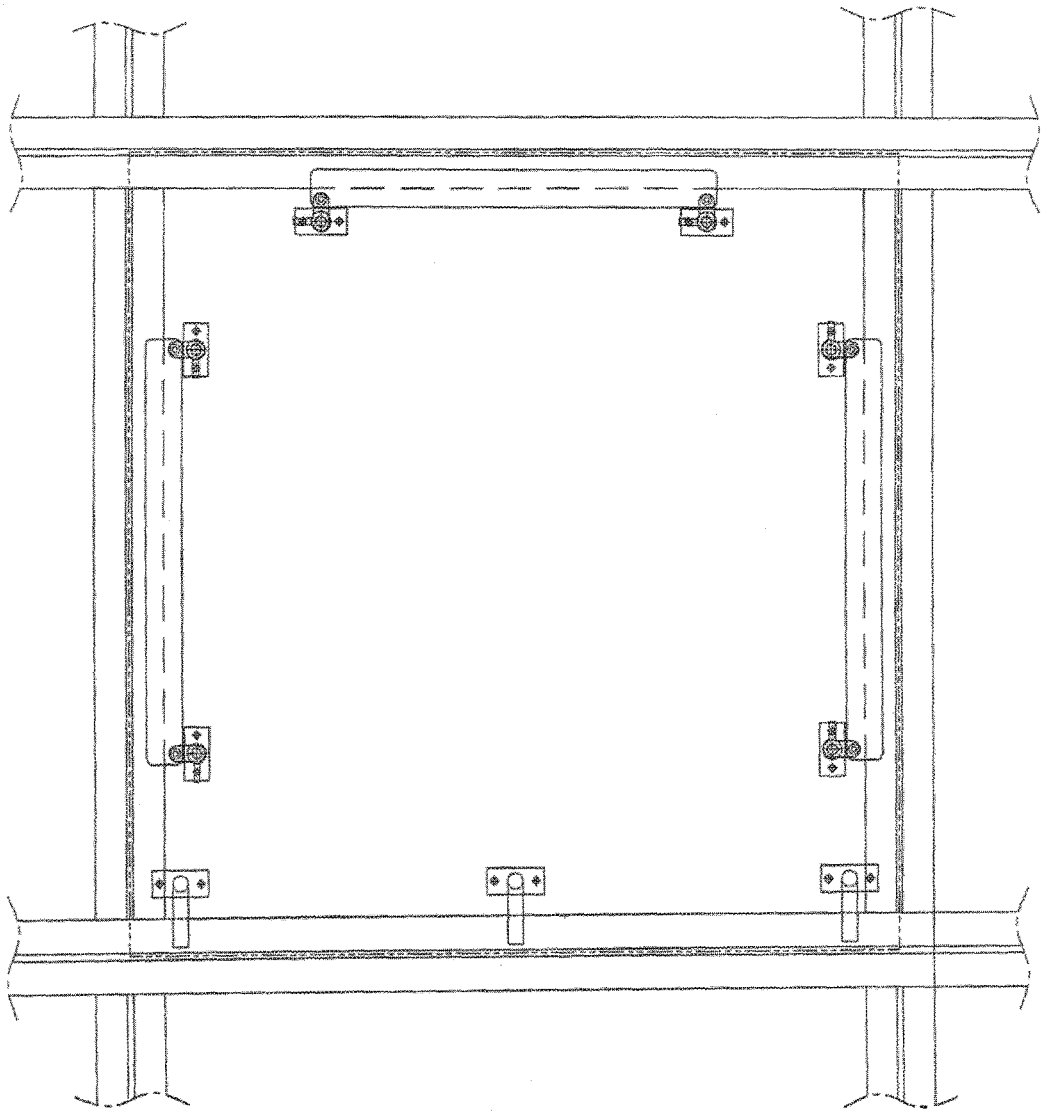

FIGS. 15, 15A, and 15A—show an installation process of the tiles when the tiles require longer resting lengths.

Figure 16:
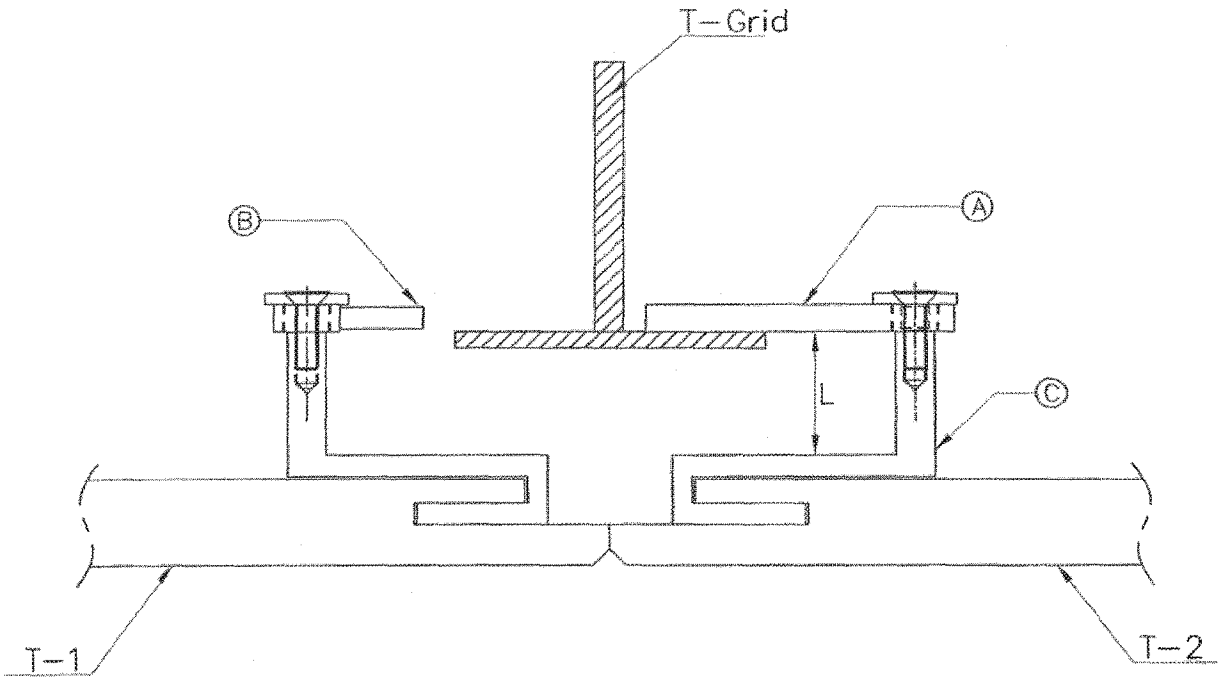

FIG. 16—shows a installation process of the tiles with kerfing.

DETAIL DESCRIPTION OF THE INVENTION

Throughout the specification reference will be made to individual figures. It should be appreciated that these references apply to the entire group of figures associated with that reference; such as, for example, reference to FIG. 2 applies to both FIGS. 2 and 2A.

Mounting assembly that is to be attached at the back side at prefixed locations is shown in FIG. 1. Item 1 is the stud fixed on the tile by suitable means. The stud on top has recess to accommodate a screw. Item 2 is the rotating lever which has two levers. The longer lever (LL) is load bearing. The short one is positioning lever (PL) and has length so that when the PL lever is facing toward T grid on either side of tile, the distance between these two PL levers is less than the opening in grid so that the tile can be lifted until the level of these levers are above flange of T grid. Item 3 is a washer and item 4 is a screw to assemble. The assembly is such that the lever can be rotated. The design is such that length from bottom of stud to bottom of LL (Load bearing lever) is kept same and is as specified elsewhere. By changing the length of the stud, the level of tile from the grid can be changed.

A plan view of the rotating lever fixed on tile before attaching to the suspension grid is shown in FIG. 2. It can be seen that while lifting enough clearance is maintained between PL and flange of T grid. When the lever is rotated 90° the long lever that remained parallel to the edge of tile comes on to rest on the flange of T member. When all levers are turned to have the long lever above flange the title is lowered and rests on the flange as shown in FIG. 3. Although it is explained that kerfing is not needed to mount the tiles as explained and that when mounting assembly can be attached on top of tile that reduces importance of thickness of tile.

It is also possible to use the tiles with kerfing to utilize same principle. FIG. 16. This can be by using individual hooks or covering most of kerfing for better support. The load bearing levers (LL) also can be individual or joined by load bearing strip as shown in FIG. 5.

Preparation for Installation:

Tiles should be prepared with mounting hook assembly located at appropriate locations to carry the weight of tile without any sag. The locations and numbers are dependent on the strength and flexibility of ceiling tile to be mounted.

As a further simplification, one side of the tile has fixed studs to enable hooking tile onto flange of T grid on one side. FIG. 4.

In case long support leverage is needed the levers are joined with long strips to distribute load FIG. 5.

Another important feature of the studs and its relative location to the edge of tile is as follows:

The length of stud is as needed to have the length from bottom of stud to bottom of long lever (L.) that is more than the thickness of tile to accommodate the tool used to turn lever.

As an example, for tile of 13 mm thickness the L, can be 25 mm to allow 8 mm tool to be inserted as will be explained latter.

The suspended ceiling structure is then fixed in standard way to have exact level because the accuracy of level of grid is reflected in the level of the ceiling membranes.

The distance of the fixing of centre of stud from the edge should be more than flange width of T grid combined with length of short lever. FIG. 6.

Tile is fixed with studs as per examples shown in FIG. 7 (1) represents non rotating fixed studs.

When longer support is needed on flange, the same will be as shown in FIG. 8. On one side non rotating (fixed) hooks are fixed for simplification. The number of hooks are placing is determined as per the physical characteristics and strength of tile.

Installations:

The installations can be started as per normal practice. The grid is laid as per normal practice. Tile is fixed with special mounting system on three sides and on one side a fixed hook is attached (item 1 in FIG. 7). The dimension of fixed hook is identical to that of rotating hook from the bottom of respective fixture to the bottom of long lever (load bearing lever). The tile is hooked on one side with fixed hooks onto flange of T grid. All rotatable levers are adjusted so that the long lever is parallel to the edge of tile and the short lever is towards flange of grid as shown in FIG. 7A. The tile is then lifted up so that the levers are above T grid flange level.

The tile is then positioned so that the levers raise above the flange and all levers are turned so that all long levers are perpendicular to flange of grid. The tile is lowered so that the long levers rest on the flanges as shown in FIG. 7B, the title is thus suspended. FIG. 8 shows elevation view of tiles on the T grid after installation is completed. While laying tile on wall side, fixed hooks are attached to tile on the side adjoining the length of the wall.

The levers are approachable from the top of the suspension grid for all tiles except closing tile/or tiles. The resting of tiles on grid is as in FIG. 8B. A insert of any shape or colour can be inserted between tiles that increases aesthetics of ceiling system. FIG. 8.

For the closing tile it is not possible to approach the lever from plenum (Ceiling void).

The procedure to fix the closing tile and also to mount or dismount any individual tile is as shown below:

Closing Tile:—Closing tile is no special tile but is one, cut to dimension of the gap and similar mounting assembly are installed. Let us consider that:

Tiles A1 to A5 are all laid and is necessary to install closing tile (C T)—FIG. 9.

Tiles A1, A5 are lifted up to the grid level. This will enable approach to the levers of mounting hook assembly FIG. 10. Simple clamps attached to grid will keep the tiles A1 and A5 in the lifted position. Then the CT tile is hooked by fixed hooks on to flange which carries tile A3 on the flange of T grid. The C T tile is then lifted so that the levers rise above the flange level. Through the gap a small bent rod with handle can be introduced in between flange towards CT and the stud. FIG. 10.

Long lever will be turned on flange. FIG. 11. After all the levers are turned likewise remove clamps or spacers and lower the tile A1 and A5 and then tile CT so that long levers on 3 sides and fixed hook on one side rest on the grid flanges and the CT tile will be in level with other tiles.

To either mount or dismount any tile in concealed grid layout as per current disclosure:—FIG. 12 is a typical grid with tiles numbered A1 to A8. MB is the chosen place where the tile has to be dismounted and another tile to be mounted.

Dismounting is as follows:

Tiles A1, A3 and A5 are lifted up and remain so by simple clamp to grid. MB is raised a bit to relieve load of tile. The bent tool is inserted between flange and stud of the MB tile. LB lever is pushed to a position parallel to flange—when all rotatable levers of MB tile are turned on three sides the tile is slid off the fixed hooks that are on one side, tile is lowered and thus removed. FIG. 13.

For mounting of M B—the tiles A1, A3 and A5 are retained in lifted position and the new tile is positioned so that the short levers face the grid and are lifted above flange. FIG. 13. The MB is fixed with fixed mountings on flange towards tile A2. After it is hooked and the MB tile is lifted so that the levers are above flange T grid. The tool is used to rotate the lever so that long studs turn on to flange. All the three A1, A3 and A5 are lowered after removing clamps or spacers and MB also lowered. LB levers will rest on respective flanges. The roofis level with all tiles. FIG. 14.

FIG. 15 shows the method when longer resting lengths are needed to support tile.

It should be mentioned that engineering details are given to explain and disclose the main parameters of the invention as elaborated. Alternate engineering arrangements for example:

Instead of rotary load bearing lever these can be push pull or snap on and off system.

All such variations will not alter the validity of the claims of this simple, economic and hastle free system.

It is clear that in totally concealed grid construction of ceiling tiles, the method shows a simple and novel way to mount and dismount any tile in grid and without need of specially constructed tile or gadgets such as spring hooks that alter the normally used T grid suspension.

The invention herein disclosed has following advangages:

1) It can be used to mount ceiling membrane of any thickness unlike double groove system with 20 mm thickness.
2) It can be used for the kind of ceiling membranes where edge grooving is not possible.
3) It can be used to mount and dismount any ceiling membrane which is part of completely concealed ceiling system.
4) This system can be used with intermediate decorative runner between tiles.
5) As the system uses standard suspension grid, retrofitting of the concealed grid system is possible.

I claim:

1. A method for installation of ceiling tiles in an improved mounting hook assembly to form a grid system, the method comprising installing the tiles at a distance from an underside of a flange of a suspended grid, the distance being more than a thickness of each tile such that, with an adjacently installed tile raised fully, a gap is created between an underside of the adjacently installed raised tile and a topside of a different adjacent installed tile to enable insertion of a tool to both engage a load bearing lever of the hook assembly onto the flange of suspended grid to mount the different adjacent installed tile and to disengage the load bearing lever of the hook assembly from the flange of the suspended grid to dismount the adjacent installed tile, the lever being configured as rotating, push pull or snap-on type to have engagement or disengagement of lever via the tool.

2. The method as claimed in claim 1, further comprising adding a decorative insert between the tiles.

3. The method as claimed in claim 1, wherein uniform thickness of the installed tile of any specified thickness can be used without kerfing.

4. The method as claimed in claim 1, further comprising inserting brackets into corresponding kerfs in the tiles.

5. The method as claimed in claim 1, wherein the tiles can be mounted or dismounted without shifting the position of already installed tiles.

6. The method as claimed in claim 1, further comprising clamping the tiles in an upwardly lifted position during mounting and dismounting of the tiles or installing a closing tile.

7. The method as claimed in claim 1, further comprising changing a length of studs to obtain multiple levels of the ceiling tiles.

* * * * *